US010851559B2

(12) United States Patent
Almazán Campillay et al.

(10) Patent No.: US 10,851,559 B2
(45) Date of Patent: Dec. 1, 2020

(54) COMBINATION OF FOUNDATION ANCHOR AND ENERGY DAMPER FOR VERTICAL LIQUID STORAGE TANKS, VERTICAL PRESSURE CONTAINER, SILO OR THE LIKE WITH A THIN WALL AND A CONTINUOUS SUPPORT

(71) Applicant: PONTIFICIA UNIVERSIDAD CATÓLICA DE CHILE, Santiago (CL)

(72) Inventors: José Luis Almazán Campillay, Peñalolén Santiago (CL); Nathaly Karina Valdebenito Tapia, Santiago (CL); Nicolás Felipe Tapia Flores, Santiago (CL)

(73) Assignee: PONTIFICA UNIVERSIDAD CATÓLICA DE CHILE, Santiago (CL)

( * ) Notice: Subject to any disclaimer, the term of this patent is extended or adjusted under 35 U.S.C. 154(b) by 0 days.

(21) Appl. No.: 16/474,808

(22) PCT Filed: Dec. 26, 2017

(86) PCT No.: PCT/CL2017/050082

§ 371 (c)(1),
(2) Date: Jun. 28, 2019

(87) PCT Pub. No.: WO2018/119534

PCT Pub. Date: Jul. 5, 2018

(65) Prior Publication Data

US 2019/0338547 A1 Nov. 7, 2019

(30) Foreign Application Priority Data

Dec. 28, 2016 (CL) ..... 3365-2016

(51) Int. Cl.
*E04H 9/02* (2006.01)

(52) U.S. Cl.
CPC ..... *E04H 9/021* (2013.01)

(58) Field of Classification Search
CPC .. E04H 9/02; E04H 9/021; E04H 7/22; E04H 2007/225; E04C 5/12
See application file for complete search history.

(56) References Cited

U.S. PATENT DOCUMENTS 6,085,472 A 7/2000 Malhotra
8,511,025 B2 * 8/2013 Kawai ..... E04B 1/24 52/167.1

(Continued)

FOREIGN PATENT DOCUMENTS

JP 2014-069844 A 4/2014
JP 2014-189313 A 10/2014
JP 2014-198598 A 10/2014

OTHER PUBLICATIONS

International Search Report dated Apr. 12, 2018; PCT/CL2017/050082.

*Primary Examiner* — Andrew J Triggs

(57) ABSTRACT

The invention relates to a combination of a foundation anchor and energy damper for vertical tanks or similar containers for liquids with a thin wall and continuous support, comprising an energy dissipation component centrally connected to a foundation anchor component by means of a linking component, the energy dissipation component comprising one or more superimposed and horizontally arranged energy dissipating plates with a rhombic shape truncated at the vertices thereof, wherein the shorter diagonal is normal to the wall of the tank and the side ends or vertices corresponding to the longer diagonal have quadrangular extensions for support on a load transmission component that is connected to the wall of the tank so as to transmit and distribute the forces developed by the one or more energy dissipating plates. Alternatively, the energy (Continued)

dissipating plates are trapezoidal with the longer parallel side tangential to the wall of the tank.

20 Claims, 5 Drawing Sheets

(56) References Cited

U.S. PATENT DOCUMENTS

| | | | | |
|---|---|---|---|---|
| 9,140,006 | B2 * | 9/2015 | Tsai | E04H 9/02 |
| 2006/0144006 | A1 * | 7/2006 | Suzuki | E04H 9/024 52/655.1 |
| 2006/0277844 | A1 * | 12/2006 | Mueller | E04H 9/02 52/167.1 |
| 2010/0107519 | A1 * | 5/2010 | Reaveley | E04H 9/02 52/167.4 |
| 2011/0107699 | A1 * | 5/2011 | Kawai | E04B 1/24 52/393 |
| 2013/0042538 | A1 * | 2/2013 | Lekhtman | E04H 9/028 52/11 |

* cited by examiner

COMBINATION OF FOUNDATION ANCHOR AND ENERGY DAMPER FOR VERTICAL LIQUID STORAGE TANKS, VERTICAL PRESSURE CONTAINER, SILO OR THE LIKE WITH A THIN WALL AND A CONTINUOUS SUPPORT

FIELD OF THE INVENTION

The present invention is related to the field of thin-walled vertical storage tanks, pressure vessels or the like with a continuous support, and to foundation anchor and energy dissipation systems that allow them to resist local uplifting and buckling in case of large earthquakes.

BACKGROUND

Vertical cylindrical tanks having a thin wall and a continuous support are very efficient structures to resist hydrostatic pressure. For this reason they are used extensively for storing water, petrol, liquefied gas, wine, olive oil, among others. However, the walls of these structures have low stiffness and resistance outside their own plane. When facing seismic loads they are very vulnerable, local buckling being the predominant mode of failure. In general, these tanks are simply supported on foundation slabs (non-anchored tanks) or they have anchor bolts (anchored tanks) which are designed to yield with tensile stress under a severe earthquake. However, once the anchors yield with the uplifting of the bottom, the tank behaves as if it were simply supported.

One way to improve seismic performance of this type of tank is by using foundation anchors combined with energy dissipating devices. However, in order for these to be efficient it is necessary that both the energy damper and its connection with the tank are designed to minimize bending stresses on the walls of the tank, which could cause failure due to local buckling.

One type of device used for protecting civil structures and components against damage by earthquakes in the field of seismic protection by means of energy dampers are metallic energy dampers, which act dissipating energy by means of ductile metal yielding.

Two examples of these metallic dampers applied to tanks are described in publication "Seismic strengthening of liquid-storage tanks with energy-dissipating anchors, Malhotra 1997" and in patent CN102852165, the first one being applied to a thin-walled vertical storage tank with a continuous support while the second one is applied to a vertical tank held in columns. In both cases, the same energy dissipation principle is used.

The device proposed by Malhotra consists of a series of groups of four vertical metal plates each: two inner plates that are pivotably connected by one end to the wall of the tank in different points of its lower outer surface, and two outer plates that are pivotably connected by one of its ends with a perimeter foundation beam. The free ends of the four vertical plates are connected with each other by means of a horizontal dissipating metal plate. This plate dissipates energy by torsion, due to the relative rotation between the inner and outer articulated plates. The main advantage of this device is that it is easy to install and replace if necessary. Its main disadvantages are: (i) a high cost due to the need to build a perimeter foundation beam to anchor the outer articulated plates; and (ii) the inner articulated plates transmit forces perpendicular to the wall of the tank equal or greater in magnitude than the forces parallel to the wall, which can produce failures by local buckling due to the combination of said forces. To avoid this failure it is necessary to reinforce the wall of the tank very strongly, thus increasing the cost of the solution.

On the other hand, the device described in CN102852165 dissipates energy by means of four upright metal plates which are bored (honeycomb-like) and disposed radial to the column and connected to the same by their internal side by means of flanges, while by their external side the plates are joined at their end thereof to a tangential metal plate anchored to the foundation. The dissipating plates are vertically deformed by bending in their own plane when the columns are lifted, concentrating plastic deformations in the vicinity of the bores. Again, the main advantage of this device is that it is easy to install and replace if necessary. Its main disadvantage is that it is complex due to the fact: (i) the bores of the dissipating plates require machining; (ii) the four tangential metal plates are anchored to the foundation by means of six anchor bolts, at least four of which must resist tension forces; and (iii) the device has an inner cylinder that allows to guide the uplifting of the column and resist horizontal cutting stresses.

A particular type of metallic dampers are the so-called TADAS, an abbreviation of "Triangular Added Stiffness and Damping", which are widely known and used in buildings structured on the basis of porticoes. They consist of one or more triangular metal plates, the bases of which are rigidly connected to an embedding plate, which in turn is linked to the beam of the portico, while the other end (vertex of the triangle) is pivotably connected to two shores directed to the base of the columns of the portico. Plastification is then produced by bending due to a relative displacement between the ends of the plates, of a direction perpendicular to its plane, produced by the seismic solicitation. An example of this can be seen in U.S. Pat. No. 5,533,307 and its main advantage is that it is very simple in its concept and design and it is easy to install. Its main disadvantage is that the connection between the base of the dissipating plates and the embedding plate must be materialized by means of an expensive welding process, or by means of longitudinal tightening bolts.

On the other hand, publication "Hysteretic behavior simulation of novel rhombic mild steel dampers" (Jia et al, 2015) proposes a metallic damper called RADAS, an abbreviations of "Rhombic Added Stiffness and Damping", which like its name indicates has rhombic shape and it works as two TADAS dampers joined by their base. Its main advantage in relation to the TADAS is that the bending moments generated on either side of the axis of symmetry of the rhombus are self-balancing, which allows to eliminate the embedding plate, thus avoiding the expensive welding process or the use of longitudinal tightening bolts.

According to the above, it would be desirable to have a combination of foundation anchor and large-earthquake energy damper for use on vertical thin-walled liquid storage tanks with a continuous support, which may bring together the advantages of the TADAS or RADAS devices and may in turn have the following characteristics: (1) easy to install and replace both in new tanks and repairing or reinforcement of existing tanks; (2) minimize (or eliminate) the force components perpendicular to the wall of the tank; (3) minimize the eccentricity of the force parallel to the wall of the tank; and (4) minimize the space required and the cost of the tank foundation anchor system.

SUMMARY OF THE INVENTION

The present invention provides a combination of foundation anchor and energy damper for thin-walled vertical liquid storage tanks with a continuous support, the combination comprising basically four components: a foundation anchor component; an energy dissipation component; a linking component and a load transmission component.

The foundation anchor component comprises means for anchoring the tank to the foundations, typically a conventional metal anchor bolt which can be embedded in the foundation (case of new tanks) or else an anchor bolt which is bored and adhered to the foundation by means of an epoxy resin (case of new or existing tanks).

The energy dissipation component comprises one or more superimposed and horizontally disposed energy dissipating plates that are centrally attached to the foundation anchor component by the linking component. The number of energy dissipating plates to be used depends on a number of variables including the energy dissipation capacity that is desired, the size of the tank and the number of anchor and energy damper combinations to be installed.

In a preferred embodiment of the invention, the energy dissipating plates have the shape of a rhombus truncated at its vertices, wherein its shorter diagonal is normal to the tank wall and wherein the lateral ends, that is, those formed by the vertices corresponding to the longer diagonal, have quadrangular shaped extensions for providing support of the plates on the load transmission component.

The linking component comprises two tightening plates, one on each side of the energy dissipating component, and respective washers, a nut and a lock nut, in which the tightening plates and the energy dissipating plate or plates have a common central through-hole to receive therethrough a bolt of the foundation anchor component and to affix the energy dissipation component to the foundation anchor component by tightening the nut and lock nut against the tightening plates and washers. Alternatively, the linking component comprises, in addition to the tightening plates, washers and lock nut, a metal coupling screwed to the free end of the anchor bolt and a removable fastening bolt passing through a common central through-hole, is inserted at the opposite end of the metal coupling and joins the energy dissipation component with the foundation anchor component.

An important aspect is that this latter linking component allows to remove and replace the energy dissipating plates or to adjust their position after an earthquake, eliminating the effects of residual deformations. To do this, the lock nut must be loosed until the dissipating plate and the removable bolt are left unloaded. Subsequently, the removable bolt must be retightened until full contact is reached between the dissipating plates and the tightening plates.

In the event that more than one energy dissipating plate is placed, the linking component incorporates separating plates between the energy dissipating plates so that they deform without interfering with each other in a large earthquake. The fastening bolt and lock nut allow the energy dissipating plates to be tightened through the tightening plates.

With respect to the load transmission component, the same is adhered to the wall of the tank and comprises means for supporting the energy dissipation component. Conveniently, these support means are formed by a set of sag plates and a tank wall reinforcement plate to which the set of sag plates are attached. The support means can also comprise any other arrangement or mechanism that allows to transmit and distribute to the wall of the tank the forces developed by the energy dissipating plate or plates. The sag plates can be joined together and to the reinforcement plate by means of welding, or can form a single piece obtained by folding and cutting.

To minimize the bending stresses on the tank wall, it is necessary to minimize the distance between the point of support of the energy dissipation component and the tank wall, which we will hereinafter call eccentricity. For this it is recommended that the energy dissipating plates are as narrow as possible.

To further reduce the eccentricity, the energy dissipating plates can be trapezoidal in shape with the longer parallel side tangent to the wall of the tank. In this way the force generated by the energy dissipating plate moves towards its inner edge, substantially decreasing the eccentricity on the wall of the tank. As with the rhombical shape, in this other embodiment of the invention the lateral ends of the plates, that is, those corresponding to the vertices formed by the longer parallel side with the non-parallel sides, have quadrangular extensions for support on the load transmission component.

Typically the metal of the energy dissipating plates can be carbon steel type A36, stainless steel type AISI 304L, or any other ductile metal. As for the rest of the components they can be of the same material as the dissipating plates, although the ductility requirement could be less demanding.

In an alternative embodiment of the invention, the ends of the dissipating plates are slidably supported against horizontal sag plates by means of two horizontal cylindrical bars welded at the ends of the dissipating plate. This embodiment has the advantage that the contact pressure between the energy dissipating plate and the horizontal sag plates decreases.

Although the main application of the invention and herein exemplary description refers to thin-walled vertical liquid storage tanks with a continuous support, the invention is also applicable to any civil or industrial works in which energy can be dissipated by the relative vertical movement between different components of the construction, especially as part of the foundation anchors, such as vertical pressure vessels that have a skirt that serves as a continuous support for the vessel to the foundations or in storage silos, mixers or similar structure.

BRIEF DESCRIPTION OF THE DRAWINGS

To facilitate the understanding of the invention, it will be described below with reference to the accompanying illustrative drawings, where.

DETAILED DESCRIPTION OF THE INVENTION

Figure 1:
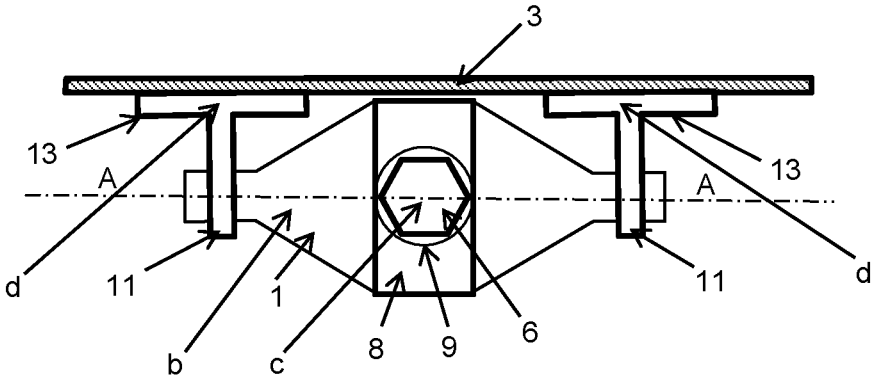
FIG. 1 depicts a top plan view of a combination of an anchor and energy damper for a thin-walled vertical tank with a continuous support according to a preferred embodiment of the invention, having a single dissipative rhombic-shaped plate.
Figure 2:
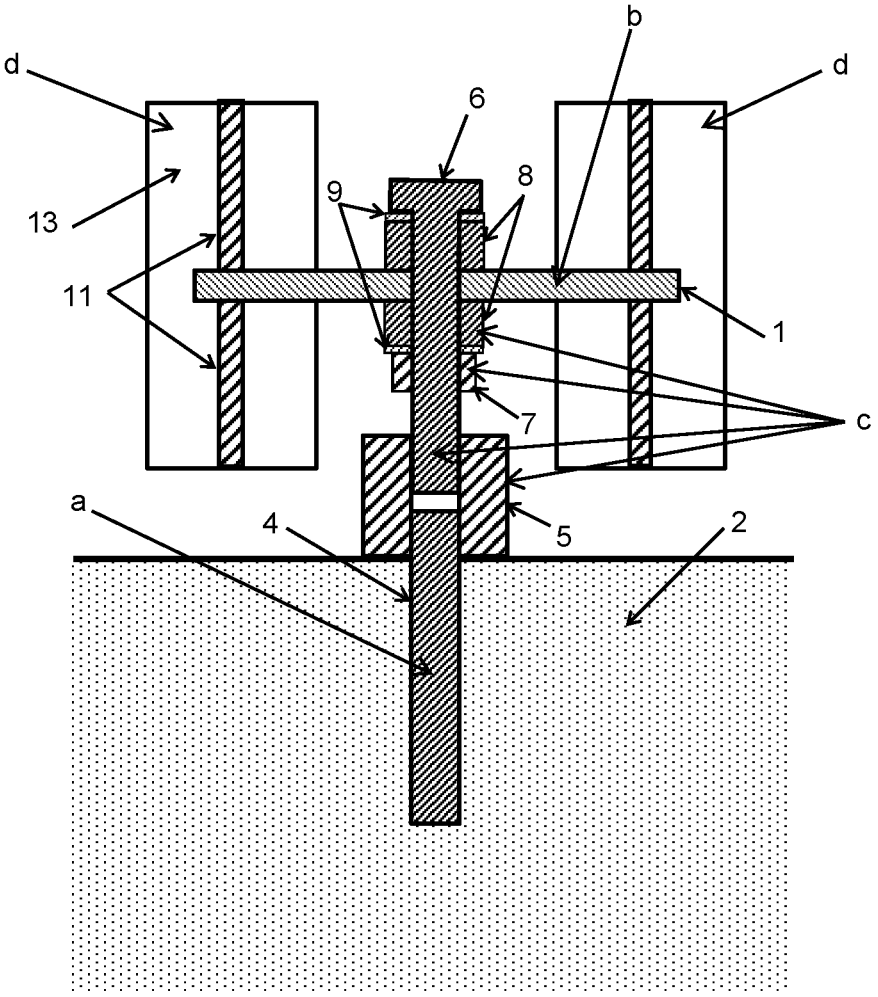
FIG. 2 depicts an elevation cross-section view of the combination of an anchor and energy damper of FIG. 1 along the plane A-A.
Figure 3:
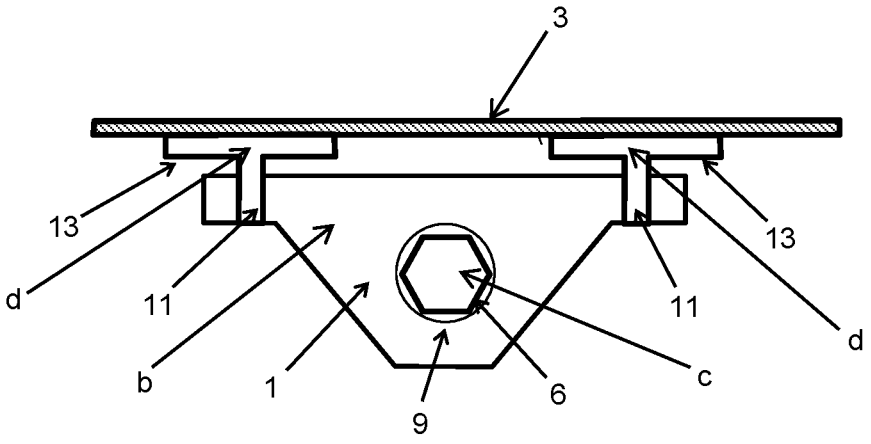
FIG. 3 is equivalent to FIG. 1 but with the energy dissipating plate variant with trapezoidal shape.

As shown in FIGS. 1, 2 and 3, of a preferred embodiment of the combination of an anchor and energy damper for a thin-walled vertical tank with a continuous support (3) supported on foundations (2), which is the object of the invention, the same includes the following elements:

- as part of the foundation anchor component (a): a foundation anchor bolt (4);
- as part of the energy dissipation component (b): an energy dissipating plate (1);
- as part of the linking component (c): metal coupling (5), removable fastening bolt (6), tightening plates (8), washers (9) and lock nut (7); and
- as part of the load transmission component (d): vertical sag plates (11), horizontal sag plates (12) and reinforcement plates (13).

Figure 4:
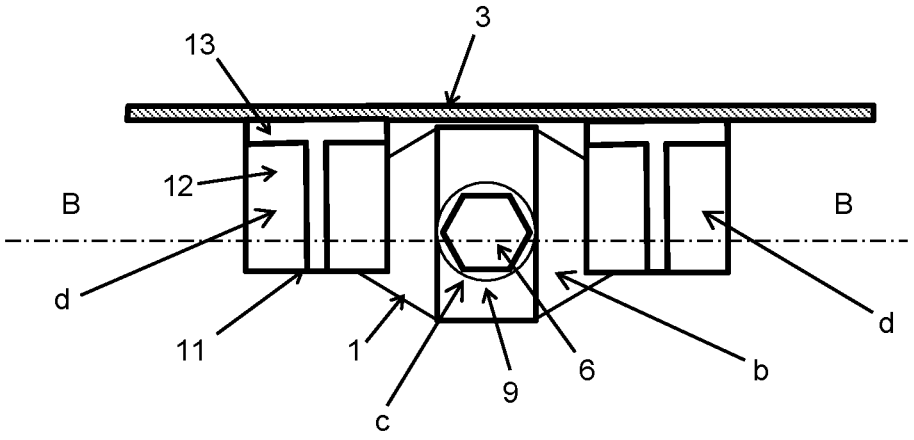
FIG. 4 shows a top plan view of a combination of an anchor and energy damper according to the invention with a single energy dissipating plate with cylindrical supports at the ends thereof.
Figure 5:
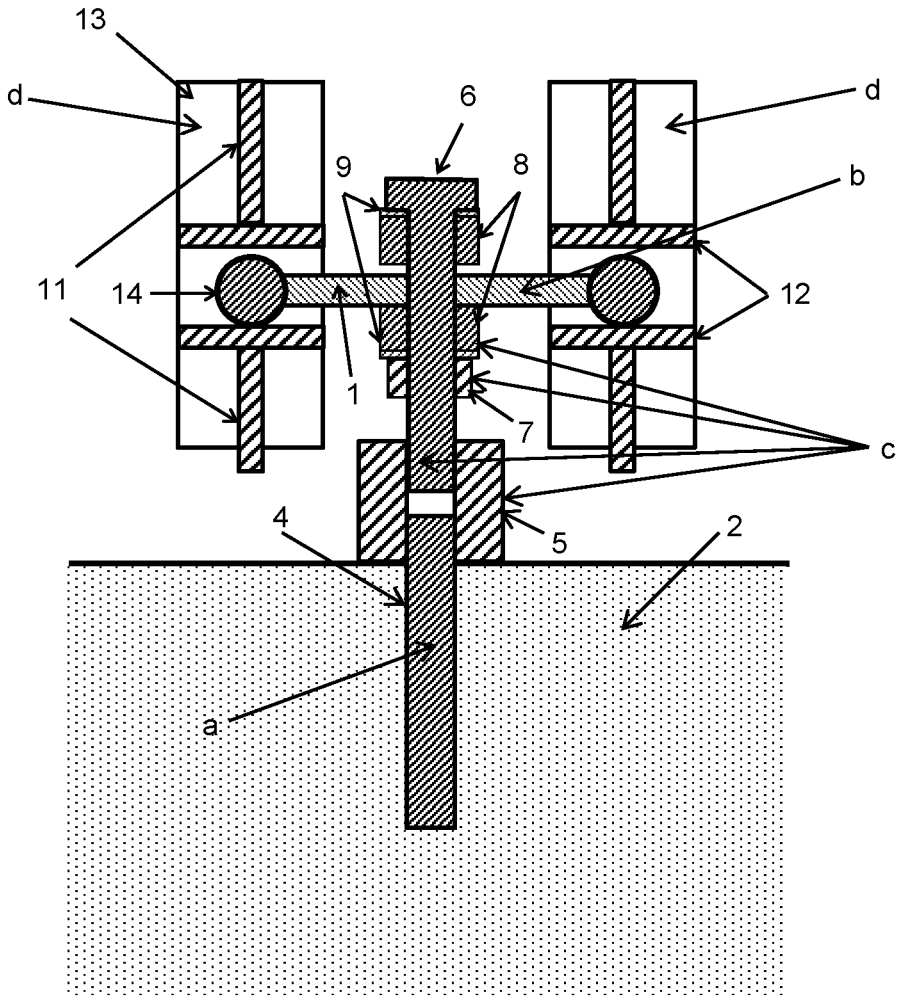
FIG. 5 shows an elevation cross-section view of the combination of an anchor and energy damper of FIG. 4 along cutting plane B-B.

On the other hand, in the combinations of an anchor and energy damper of FIGS. 4 and 5 it is noted that that the energy dissipating plates (1) are provided with cylindrical bars (14) at their lateral ends, which are slidable along the horizontal sag plates (12) that form part of the load transmission component.

Figure 6:
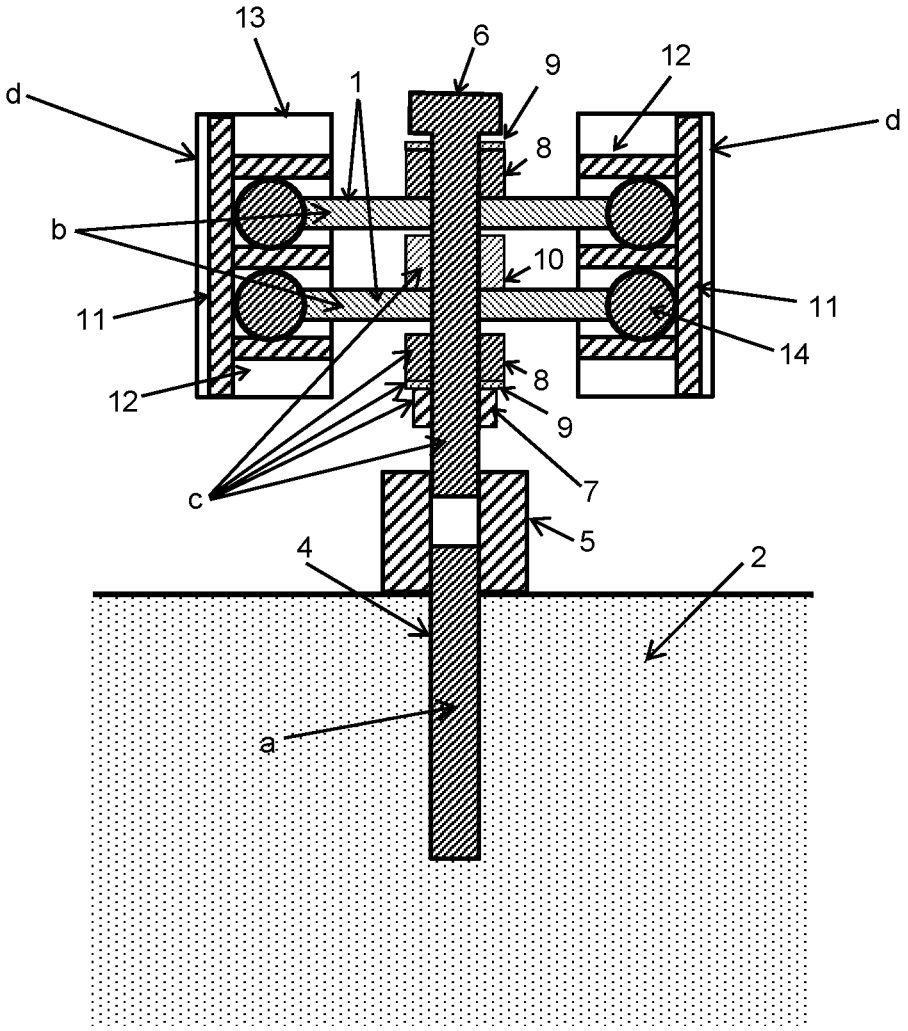
FIG. 6 represents an elevation cross-section view of the combination of an anchor and energy damper of FIG. 4 along cutting plane B-B with 2 energy dissipating plates.

Finally, as is illustrated in FIG. 6, the combination of an anchor and energy damper according to the invention can have multiple energy dissipating plates, in this case two, and for this the linking component has separating plates (10) to avoid that they interfere with each other when they plastically deform in a large earthquake.

EXAMPLE OF APPLICATION

Figure 7:
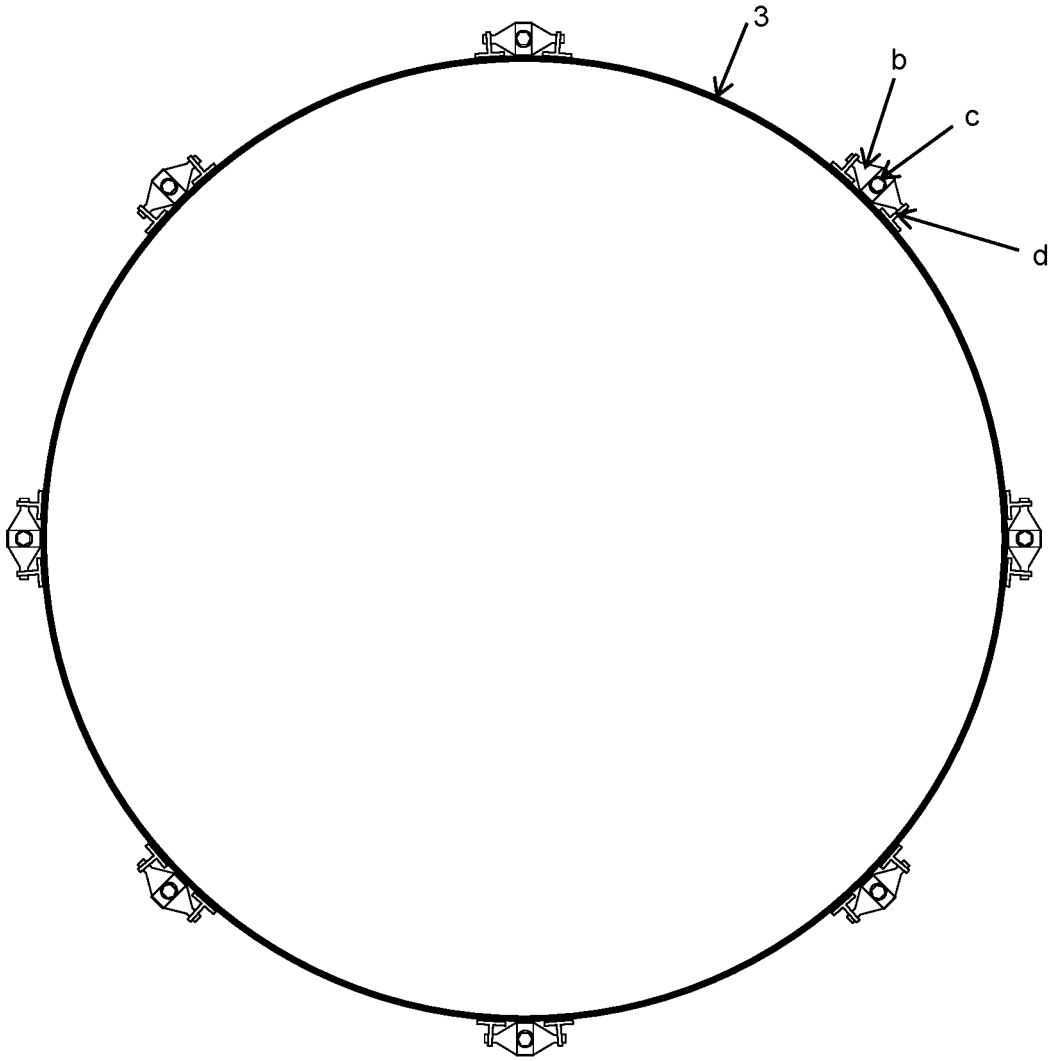
FIG. 7 shows a top plan view of a typical installation of combinations of anchor and energy damper according to the invention, comprised of 8 combinations with the energy dissipating plates of FIGS. 1 and 2, installed on a thin-walled cylindrical vertical tank with a continuous support.

In FIG. 7 a typical distribution of the combination of an anchor and energy damper according to the invention can be seen around the lower part of the wall of a cylindrical vertical tank with a thin wall and a continuous support (3). In this case, eight combinations of anchor and energy damper have been anchored to the foundations and fixed to the tank (3), each with a rhombic type energy dissipating plate.

The invention claimed is:

1. A combination of foundation anchor and energy damper for a thin-walled and continuous support structure supported on foundations, wherein the combination comprises:

a foundation anchor component;

an energy dissipation component;

a linking component; and a load transmission component;

wherein the energy dissipation component is centrally attached to the foundation anchor component by the linking component and wherein the energy dissipation component is constituted by one or more superimposed and horizontally arranged energy dissipating plates having a rhombus shape as formed by two diagonals, a shorter one and a longer one, connecting pairs of opposite vertices, and two pairs of parallel sides, the rhombus shape being truncated at its vertices and the vertices corresponding to the longer diagonal defining lateral ends of the energy dissipating plates, wherein the one or more energy dissipating plates are disposed in a manner such that the shorter diagonal of the rhombus shape is normal to the thin-wall and wherein the lateral ends have quadrangular extensions for support on the load transmission component, which is attached to the thin-wall so as to transmit and distribute forces developed by the energy dissipating plate or plates to the thin-wall.

2. The combination of foundation anchor and energy damper according to claim 1, wherein the linking component comprises two tightening plates, one on each side of the energy dissipation component, and respective washers, a nut and a lock nut, wherein the tightening plates and the energy dissipating plate or plates have a common central through-hole for receiving therethrough an anchor bolt of the foundation anchor component and for attaching the energy dissipation component to the foundation anchor component by means of tightening the nut and lock nut against the tightening plates and washers.

3. The combination of foundation anchor and energy damper according to claim 2, wherein the anchor bolt of the foundation anchor component is a conventional metal anchor bolt embedded in the foundations.

4. The combination of foundation anchor and energy damper according to claim 2, wherein the anchor bolt of the foundation anchor component is perforated and adhered to the foundation by means of an epoxy resin.

5. The combination of foundation anchor and energy damper according to claim 1, wherein the foundation anchor component comprises an anchor bolt with one end on the foundations and an opposite, free end for attachment of the energy dissipation component, wherein the linking component comprises two tightening plates, one on each side of the energy dissipation component, respective washers, a lock nut and a metal coupling with an end screwed to the free end of the anchor bolt of the foundation anchor component, wherein the tightening plates and the energy dissipating plate or plates have a common central through hole for receiving therethrough a removable fastening bolt that is inserted in an opposite end of the metal coupling to attach the energy dissipation component to the foundation anchor component by means of tightening the lock nut and the removable fastening bolt against the tightening plates and washers.

6. The combination of foundation anchor and energy damper according to claim 5, wherein the anchor bolt of the foundation anchor component is a conventional metal anchor bolt embedded in the foundations.

7. The combination of foundation anchor and energy damper according to claim 5, wherein the anchor bolt of the foundation anchor component is perforated and adhered to the foundation by means of an epoxy resin.

8. The combination of foundation anchor and energy damper according to claim 1, wherein the energy dissipation component comprises two or more energy dissipating plates and the linking component incorporates separating plates between the energy dissipating plates so that the latter deform without interfering with each other in an earthquake.

9. The combination of foundation anchor and energy damper according to claim 1, wherein the load transmitting component comprises: a group of horizontal sag plates that serve as a support means for the lateral ends of the energy dissipating plate or plates; and a reinforcement plate of the thin-wall to which the group of horizontal sag plates is attached.

10. The combination of foundation anchor and energy damper according to claim 9, wherein the energy dissipating plate or plates are provided at their lateral ends with cylindrical bars, which are slidable along the horizontal sag plates of the load transmission component.

11. A combination of foundation anchor and energy damper for a thin-walled and continuous support structure supported on foundations, wherein the combination comprises:

a foundation anchor component;

an energy dissipation component;

a linking component; and a load transmission component;

wherein the energy dissipation component is centrally attached to the foundation anchor component by the linking component and wherein the energy dissipation component is constituted by one or more superimposed and horizontally arranged energy dissipating plates having a trapezoidal shape as formed by two parallel sides, a shorter one and a longer one, two other sides that are not parallel and four vertices where the parallel sides meet the non-parallel sides, the vertices of the longer parallel side with the non-parallel sides defining lateral ends of the energy dissipating plates, wherein the one or more energy dissipating plates are disposed in a manner such that the longer parallel side of the trapezoidal shape is tangent to the thin-wall, wherein the lateral ends have quadrangular extensions for support on the load transmission component, which is attached to the thin-wall so as to transmit and distribute forces developed by the energy dissipating plate or plates to the thin-wall.

12. The combination of foundation anchor and energy damper according to claim 11, wherein the linking component comprises two tightening plates, one on each side of the energy dissipation component, and respective washers, a nut and a lock nut, wherein the tightening plates and the energy dissipating plate or plates have a common central through-hole for receiving therethrough an anchor bolt of the foundation anchor component and for attaching the energy dissipation component to the foundation anchor component by means of tightening the nut and lock nut against the tightening plates and washers.

13. The combination of foundation anchor and energy damper according to claim 12, wherein the anchor bolt of the foundation anchor component is a conventional metal anchor bolt embedded in the foundations.

14. The combination of foundation anchor and energy damper according to claim 12, wherein the anchor bolt of the foundation anchor component is perforated and adhered to the foundation by means of an epoxy resin.

15. The combination of foundation anchor and energy damper according to claim 11, wherein the foundation anchor component comprises an anchor bolt with one end on the foundations and an opposite, free end for attachment of the energy dissipation component, wherein the linking component comprises two tightening plates, one on each side of the energy dissipation component, respective washers, a lock nut and a metal coupling with an end screwed to the free end of the anchor bolt of the foundation anchor component, wherein the tightening plates and the energy dissipating plate or plates have a common central through hole for receiving therethrough a removable fastening bolt that is inserted in an opposite end of the metal coupling to attach the energy dissipation component to the foundation anchor component by means of tightening the lock nut and the removable fastening bolt against the tightening plates and washers.

16. The combination of foundation anchor and energy damper according to claim 15, wherein the anchor bolt of the foundation anchor component is a conventional metal anchor bolt embedded in the foundations.

17. The combination of foundation anchor and energy damper according to claim 15, wherein the anchor bolt of the foundation anchor component is perforated and adhered to the foundation by means of an epoxy resin.

18. The combination of foundation anchor and energy damper according to claim 11, wherein the energy dissipation component comprises two or more energy dissipating plates and the linking component incorporates separating plates between the energy dissipating plates so that the latter deform without interfering with each other in an earthquake.

19. The combination of foundation anchor and energy damper according to claim 11, wherein the load transmitting component comprises: a group of horizontal sag plates.

20. The combination of foundation anchor and energy damper according to claim 19, wherein the energy dissipating plate or plates are provided at their lateral ends with cylindrical bars, which are slidable along the horizontal sag plates of the load transmission component.

* * * * *